United States Patent [19]

Donahue

[11] Patent Number: 5,044,418

[45] Date of Patent: Sep. 3, 1991

[54] WINDOW TREATMENT

[75] Inventor: Nadine G. Donahue, St. Louis, Mo.

[73] Assignee: Midwest Curtain Co. Inc., St. Louis, Mo.

[21] Appl. No.: 574,062

[22] Filed: Aug. 29, 1990

[51] Int. Cl.[5] ..... A47H 1/00

[52] U.S. Cl. ..... 160/330; 160/84.1; 160/134; 29/24.5

[58] Field of Search ..... 160/84.1, 330, 134, 160/371, 378; 29/24.5

[56] References Cited

U.S. PATENT DOCUMENTS

| | | | |
|---|---|---|---|
| 190,348 | 5/1877 | May | 160/134 |
| 2,436,811 | 3/1948 | Kenny et al. | 211/105.2 |
| 4,825,611 | 5/1989 | Bassett | 160/372 X |

*Primary Examiner*—Blair M. Johnson
*Attorney, Agent, or Firm*—Kalish & Gilster

[57] ABSTRACT

An arch-shaped window treatment has a front and back and consists of a frame and a flexible material construction mounted thereon. The frame has a curved semi-rigid upper portion and a lower elongated piece. The curved portion and elongated piece are detachably connected at the respective ends thereof. A ruffle is formed from the flexible material construction and extends outwardly from the curved portion of the frame. Soft folds are created in the body portion of the flexible material construction which essentially fills the area within the frame. The folds are formed by virtue of hems of the flexible material construction being threaded over portions of the frame and the remaining excess fabric being further gathered on a cord which is tied at a central point along the straight portion of the frame. A decorative piece is formed of flexible material and applied so as to conceal the cord, a portion of the lower straight rod and the focus of gathered flexible, material to provide an arch-shaped window treatment having a fan-like appearance. The new window treatment may be substantially identical from the front and back sides thereof and mounted on a wall so as to be easily removed and reversed.

16 Claims, 3 Drawing Sheets

FIG.1
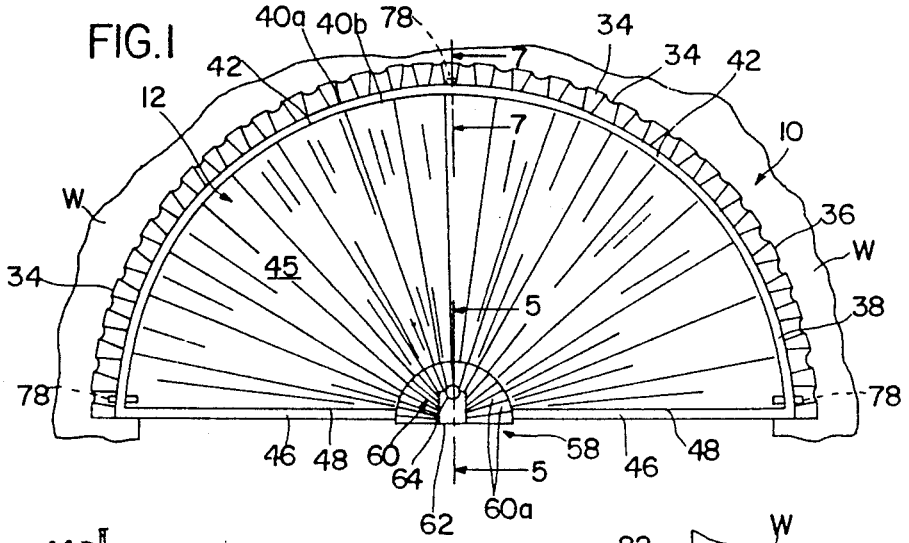
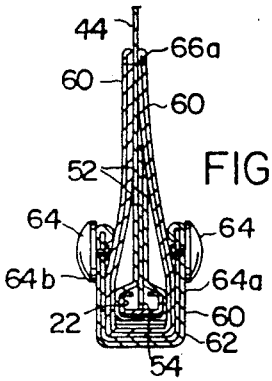
FIG.5
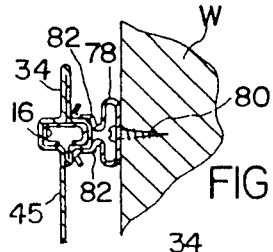
FIG.7
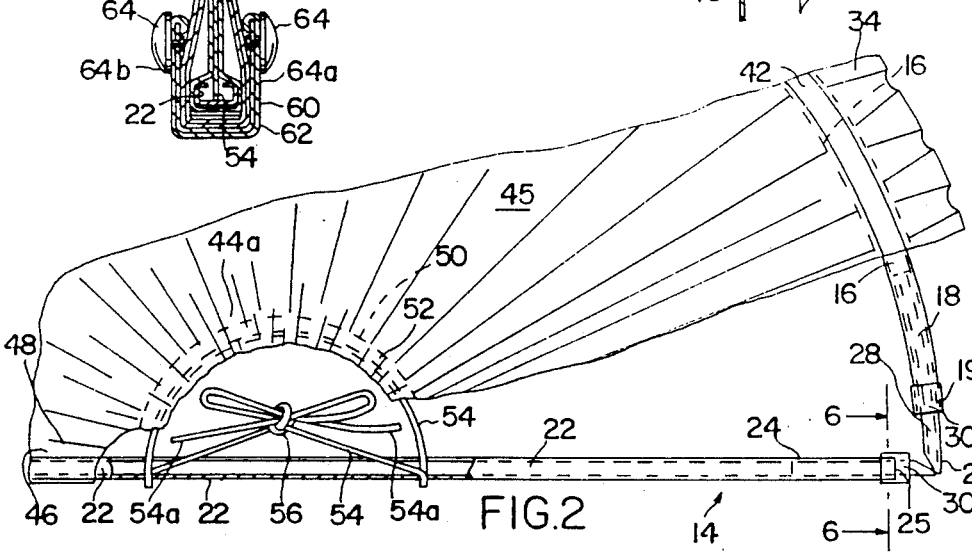
FIG.2
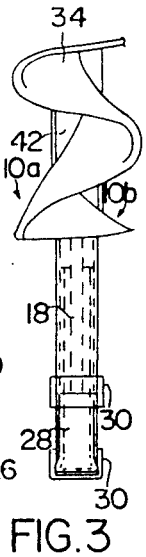
FIG.3
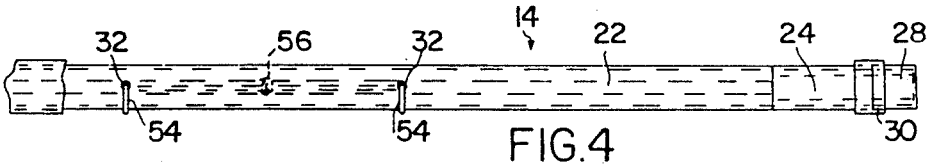
FIG.4
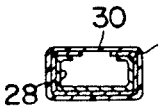
FIG.6

WINDOW TREATMENT

CROSS REFERENCE TO RELATED APPLICATION

U.S. design patent application, Ser. No. 07/448,587, Window Treatment.

BACKGROUND AND SUMMARY OF THE INVENTION

This invention relates, in general, to the field of window treatments, and, more particularly to a novel construction for a reversible arch-shaped window treatment for use in placement on a wall above a window or directly over a similarly shaped window.

Various devices have been known for decorating the wall space above a window. For example, cornices, and valances are conventionally used. By contrast, the present invention relates to the specific apparatus and method for constructing same, of an arched or sunburst shaped window treatment as generally illustrated in U.S. design application Ser. No. 07/448,587, filed Dec. 7, 1989 by Ms. Nadine G. Donahue, the inventor herein.

Previously, arch-shaped window treatments have suffered from several limitations. Ordinarily, a great deal of fabric was wasted because the window treatment was formed by draping and attaching the fabric over a curved rod, wadding the excess at the base of the apparatus and tying same with a cord prior to cutting the fabric. If preferred, an excess of fabric sufficient from which to form a decorative center piece was left. Centering and forming the decoration at the base of the window treatment required a certain amount of skill on the part of the laborer.

Once formed, the conventional window treatment presented problems in that the corners of the rods would sometimes became exposed as a result of the fabric slipping therefrom. Moreover, after a period of use, the exposed surface of the fabric would necessarily become dusty and soiled, requiring removal from the rod and laundering or replacement of the entire window treatment. Also, it has been difficult to mount known window treatments on a wall in such a manner that the fabric position on the rod is not disturbed and so that the window treatment may be easily and quickly mounted, removed or replaced.

Accordingly, it is an object of the present invention to provide an arch-shaped window treatment which may be formed to a preselected size, using a minimum amount of fabric.

It is another object of the present invention to provide a window treatment having the feature stated which is provided with a decorative attachment at the center base thereof which may be positioned simply and accurately with a minimum amount of training required for the manufacturer.

It is a further object of the present invention to provide a window treatment having the features stated which is reversible and which may be easily and quickly mounted on a wall and removed therefrom for remounting.

It is a still further object of the present invention to provide a window treatment having the features stated which is capable of being mounted without a substantial disturbance of the positioning of the fabric thereon.

It is yet another object of the present invention to provide a window treatment having the features stated which is capable of being provided in a variety of sizes and shapes of arch.

In furtherance of these objects, the present invention is, briefly, a window treatment consisting of a frame apparatus and a flexible material construction mounted thereon. The frame apparatus has a curved, semi-rigid upper portion having first and second ends and forms an arch therebetween. A lower elongated frame piece has first and second ends and extends therebetween. The frame also has means for connecting the first and second curved semi-rigid portion ends to the first and second lower elongated piece ends, respectively. The flexible material construction has a front and a back, and a curved upper edge having first and second ends extends therebetween. An elongated lower edge of the flexible material construction has first and second ends extending therebetween, the first and second ends of the curved upper edge intersecting the first and second ends of the elongated lower edge, respectively. A body portion extends between the upper curved and lower elongated edges and has a gathered focus formed centrally along the elongated lower edge. A decorative piece is disposed centrally along the elongated lower edge and outward thereof and has a size and shape such as to be capable of concealing the gathered focus of the flexible material construction body portion. The above construction thus provides an arch-shaped window treatment having a fan-like appearance.

Also in furtherance of these objects, the flexible material construction of the new window treatment has a curved upper edge which includes a hem formed longitudinally thereon for housing the semi-rigid, curved frame portion. A cord having a length less than that of the lower elongated edge of the flexible material construction is included for the gathering thereof. The lower elongated edge includes a hem formed longitudinally thereon for housing the cord and the flexible material construction also has opposing ends provided with hems for passage therethrough of the lower elongated frame piece of the window treatment frame so as to mount a flexible material construction thereon.

Elbow joints make up the means for detachably connecting the first and second semi-rigid curved portion ends to the first and second lower elongated piece ends, respectively. Protective sleeves mounted circumferentially upon each of the first and second ends of the lower elongated piece and the first and second ends of the curved rigid upper portion of the frame apparatus prevent snagging of the flexible material portion as it is mounted on the frame.

The decorative portion of the flexible material construction is of a rosette form having folds. The folds may be pressed into sharp pleats.

The lower elongated piece of the frame apparatus defines a plurality of separated holes substantially midway along a central longitudinal axis thereof.

Also in furtherance of the above objects, the window treatment is reversible, the front and back thereof being substantially identical; the flexible material construction having a front and back which are substantially identical and the decorative portion is disposed so as to conceal the gathered focus of the flexible material construction from view from both the front and back of the window treatment.

The decorative piece also includes a gathered point formed midway along the diameter thereof and the gathered point may be concealed from view from both sides of the window treatment by applying a flexible material tab outward of the decorative piece, over the gathered point on both the front and back of the window treatment and attaching a button at each of two opposing ends of the tab.

Also in furtherence of these objects, the method for producing the new arch-shaped window treatment includes cutting a one-piece longitudinal blank of flexible material to a predetermined size such that said blank has front and back sides and is provided with a curved, upper longitudinal edge, a lower longitudinal edge and two opposing end edges of equal length formed perpendicular to said lower longitudinal edge at opposing ends thereof and extending to opposing ends of the curved upper edge. A hem is formed in the lower longitudinal edge of the blank, the hem being of such width as to permit passage therethrough of a cord. A hem is also formed in the curved, upper longitudinal edge of the flexible material blank of such width as to accommodate passage therethrough of a frame upper curved portion. Another hem is formed at each end edge of the blank, of such width as to accommodate the passage therethrough of a frame elongated portion. Entrance sites are formed in the curved upper longitudinal edge hem and the lower longitudinal edge hem, for passage therethrough of window treatment frame pieces and a gathering cord, respectively. The flexible material blank is mounted upon a window treatment frame having a semi-rigid, upper curved portion and a lower elongated piece. The first and second ends of the curved frame portion are connected to the first and second ends of the lower elongated piece, respectively.

Then the entrance sites in the curved upper longitudinal edge hem are closed for a neat appearance and the excess flexible material is gathered substantially centrally along the frame elongated portion by inserting a cord shorter than the length of the lower elongated edge hem into an entrance site formed therein through the hem, and pulling on opposing ends of the cord. The cord is then tied so as to maintain the gathered portion of the flexible material substantially at the center of the lower elongated frame piece. Then a decorative piece is applied so as to shield from view the lower elongated frame piece, the tied cord and the lower hem gathered thereon. The window treatment is then on a wall in such manner that it is easily removed.

Still in furtherance of the above objects, the new window treatment is formed, briefly, by a method including forming entrance sites in the upper longitudinal hem and the lower elongated hem substantially adjacent to opposing ends thereof and mounting the flexible material blank upon a window treatment frame having an arched portion and a lower elongated piece. The arched portion of the frame and the lower elongated piece of the frame are consecutively inserted through the entrance sites in the upper longitudinal edge hem and connected at opposing ends thereof so as to be detachable, by inserting arms of elbow joints into the respective ends of corresponding frame parts. Thus, each straight end edge of the blank is mounted on the lower elongated piece of the frame and the curved frame portion is retained in the hem formed in the curved upper longitudinal edge of the window treatment blank. The entrance sites are closed by placement of closely defined stitches into the fabric material construction so that the finished window treatment has a neat appearance. The gathered excess flexible material is maintained in a focus by passing opposing ends of the cord through holes defined in the straight elongated piece and a knot is formed from the cord ends.

The decorative piece is formed briefly from flexible material by performing the following steps:

cutting a rectangular decorative piece blank of a predetermined size from flexible material and folding the decorative piece blank in half along a central lengthwise axis thereof, such that the first and second longitudinal edges meet at corresponding points along the respective lengths thereof. The first and second longitudinal edges are then connected along the lengths thereof and folds are formed perpendicular to the longitudinal axis of the folded decorative piece blank along the entire length thereof the folded decorative piece blank is turned so that the first end meets the second end and a substantially circular planar shape is formed by the blank and a hem is formed in the lower longitudinal edge of the blank, the hem being of such width as to permit passage therethrough of a cord. A hem is formed in the curved, upper longitudinal edge of the flexible material blank; the curved, upper longitudinal edge hem being of such width as to accommodate passage there through of a frame curved portion. A hem is formed at each end edge of the blank of such width as to accommodate the passage therethrough of a frame straight elongated portion. Entrance sites are formed in the upper longitudinal edge hem and the lower elongated hem, for passage therethrough of window treatment frame pieces and a gathering cord, respectively. The flexible material blank is mounted upon a window treatment frame having an arched portion and a straight elongated portion. Then the respective first and second ends of the curved frame portion and the elongated frame piece are connected and the entrance sites are closed. Excess flexible material is gathered substantially centrally along the elongated frame piece by inserting a cord shorter than the length of the hem formed in the lower longitudinal edge of the blank into and through said hem and pulling on opposing ends of the cord. The cord is tied so as to maintain the gathered portion of the flexible material substantially at the center of the elongated frame piece.

Also in furtherance of the above objects, the window treatment is formed so as to have a substantially identical front side and back side, so as to be reversible, by cutting the one-piece longitudinal blank from flexible material which has front and back sides which are substantially identical. Also, the folded decorative piece is placed outward of and around the lower elongated frame piece such that it and the tied cord and lower hem gathered thereon are hidden from view from either side of the window treatment by one of the decorative piece halves. The window treatment is then mounted on a wall so that it is easily removed and reversed.

Also the folds of the decorative piece are attached to the window treatment by stitching each fold to the flexible material body. A gathered point is formed on the decorative piece by the folding, turning and further folding thereof and is covered from view by applying thereover a tab of flexible material outward of and around the decorative piece and attaching a button to each end of the tab such that the window treatment appears to be substantially identical from both front and back sides thereof and thus is reversible.

Moreover, the folds of the decorative piece blank are pressed so as to form sharp pleats perpendicular to the longitudinal axis of the folded decorative piece blank. Thus forming a circular planar shape which is turned to provide a rosette appearance. The further folding thereof into a semi-circle causes the decorative piece to acquire a sunburst appearance with the pleats radiating outward from the gathered point. The window treatment is mounted on a wall by replacement of chips thereon such as the window treatment may be simply slipped between the arms of the clips and easily removed therefrom for reversing or replacement without the use of tools.

BRIEF DESCRIPTION OF THE DRAWINGS

FIG. 1 is a front elevational view of a window treatment constructed in accordance with and embodying the present invention.

FIG. 2 is a front elevational view, partially broken away to illustrate the base and corner construction of the window treatment of FIG. 1.

FIG. 3 is an end elevational view, partially broken away to illustrate the corner construction of the window treatment of FIG. 1.

FIG. 4 is a base elevational view partially broken away of the window treatment of FIG. 1.

FIG. 5 is a partial vertical sectional view taken on line 5—5 of FIG. 1.

FIG. 6 is a vertical sectional view taken on line 6—6 of FIG. 2.

FIG. 7 is a vertical sectional view taken on line 7—7 of FIG. 1.

DESCRIPTION OF THE PREFERRED EMBODIMENT

Figure 8:
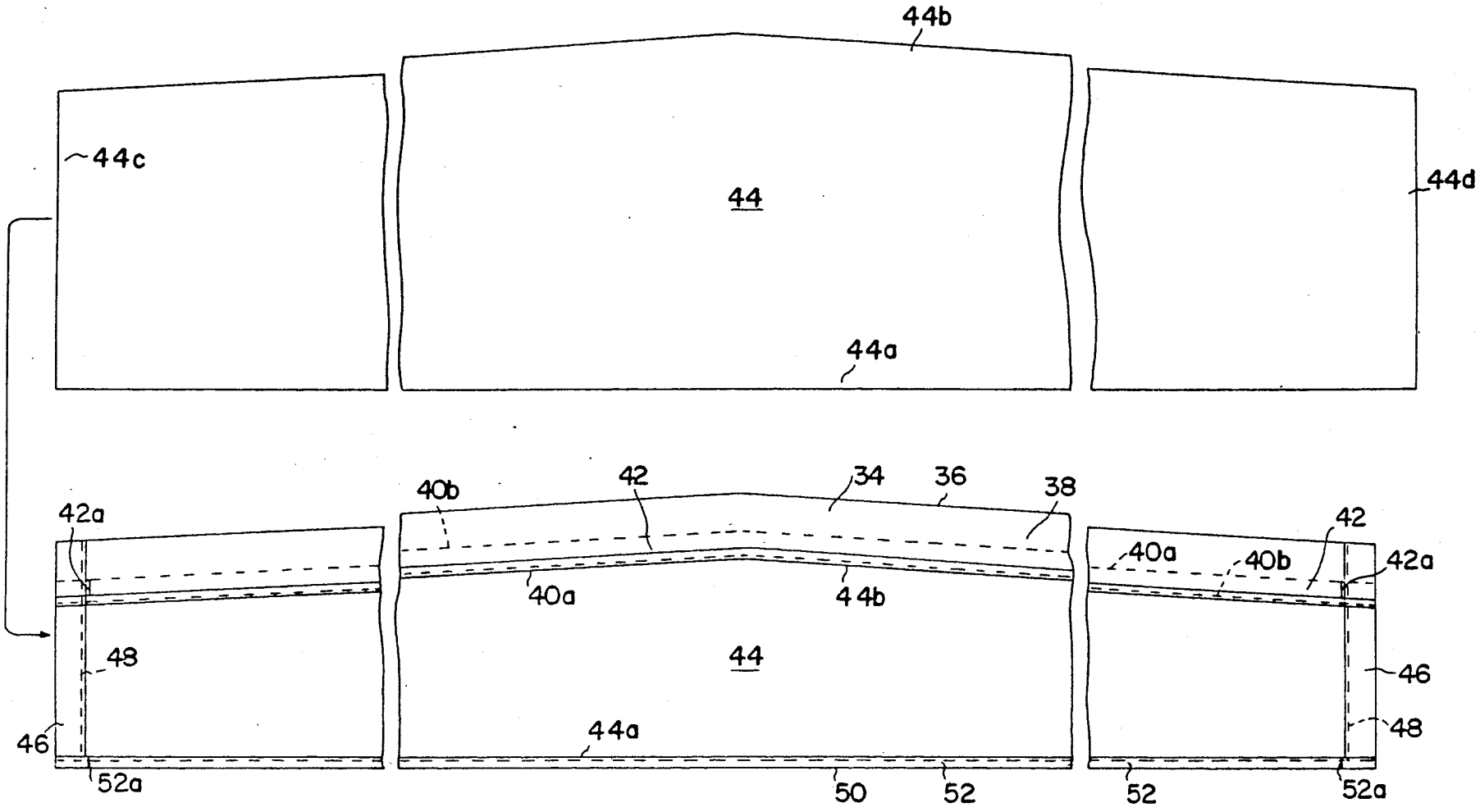
FIG. 8 is a plan view of the fabric for the construction of the window treatment of FIG. 1.

Referring now by reference characters to the accompanying drawings, illustrated in FIG. 1 and generally designated 10, is an arch-shaped window treatment constructed in accordance with and embodying the present invention. Window treatment 10 consists generally of a flexible material or fabric construction 12 mounted on a frame 14. As may be easily seen, the flexible material used for forming fabric construction 12 may be of a number of varieties though preferably consists of a woven fabric as is conventionally used for curtain type material.

FIG. 2 illustrates that frame 14 is formed of elongated pieces, one 16 of which is semi-rigid and curved into a preferably smooth, arched shape and is provided with opposing ends 18, and the other 22 of which is elongated, preferably straight, preferably semi-rigid and provided with opposing ends 24. Straight piece 22 extends between ends 18 of arched (or curved) piece 16 and is attached thereto by elbow joints 26, arms 28 of which slide snugly into corresponding ends 18, 24 of curved piece 16 and straight piece 22, respectively. Ends 18, 24 are preferably each provided with a sleeve 30, such as of soft plastic, for shielding sharp edges 19, 25. A cross-section of end 24 with arm 28 therein and encompassed by sleeve 30, is shown in FIG. 6. Straight elongated piece 22 preferably defines two small holes 32 separated as, for example, by a distance of inches from each other and located substantially centrally along its central longitudinal axis.

Frame 14 is preferably formed of thin metal, such as is used for conventional curtain rods so as to be lightweight, yet strong and slightly flexible. However, it may be formed at least partially of other materials, such as plastic. Conceivably, straight piece 22 could even be formed of material such as cording which is very flexible, yet capable of being pulled taut and curved piece 16 could be entirely rigid.

Along the entire length of semi-rigid arch-shaped piece 16 and exterior thereto extends a ruffle 34 of flexible material having a double thickness (as explained hereafter), an outer edge 36, and a base 38 (FIGS. 1–3). Parallel to base 38 of ruffle 34 extend two parallel lines of stitching 40A, 40B, separated from each other by sufficient space to define a tunnel, or housing 42 (FIG. 1–3, 7, 8) for semi-rigid curved piece 16 within the double thickness of flexible material (preferably fabric) of which ruffle 34 and housing or tunnel 42 are comprised.

A semi-circular or fan-shaped area defined by frame 14 is substantially filled by a single thickness of flexible material which forms a fabric body 45 of fabric construction 12; such fabric body 45 extending from line of stitching **40*b* inward and across the area defined by frame 14 to terminate in a hem 46 attached by a lines of stitching 48. It is understood that fabric body 45** may be formed of other flexible material such as for example plastic sheeting.

A line of stitching 50 (FIG. 2) attaches and defines a housing 52 for passage therethrough of cord 54 which gathers a lower edge **44*a* of fabric body 45 and connects it to straight lower elongated frame piece 22 by passing through holes 32 defined therein and terminating in a knot 56**.

Preferably, hem 50 and knot 56 are hidden from view by a decorative piece 58, such as for example, a "rosette" (as illustrated) having a folded portion 60 and a centrally positioned tab 62. In the preferred embodiment decorative piece (rosette) 58 passes outward of beneath straight piece 22 and overlays both a front side **10*a* and back side 10*b* (FIG. 3) of window treatment 10. Likewise, tab 62 is formed to pass outwardly of and centrally upon decorative piece 58 and is attached thereto as by stitching 64*a* and/or upholstery tacks 64*b* on each side 10*a*, 10*b*, preferably with an identical button 64 on each side 10A, 10*b* such that window treatment 10 may be reversible. Folded portion 60 of decorative piece 58 preferably consists of individual sharp pleats 60*a* (FIG. 1) secured to window treatment 10 by various means, such as by "tacking" to fabric body 45 with stitches 66*a* (FIG. 5**).

FIG. 8 partially illustrates the preferred method for manufacturing window treatment 10. An elongated blank 44 of flexible material is cut to a predetermined size such that lower edge **44*a* is straight, side ends 44*c*, 44*d* are of equal length, and perpendicular to a lower edge 44*a* and extend to intersect with upper edge 44*b* which forms a substantially symmetrical convex curve such that the greatest distance from edge 44*a* to edge 44*b* is along an imaginary line perpendicular to and midway along a longitudinal axis of blank 44** and..

Flexible material (or fabric) blank ends **44*c*, 44*d* are folded inward upon themselves so as to form hems 46 held in place preferably by lines of stitching 48 which of course penetrate both resultant fabric thicknesses and are inserted parallel to and substantially adjacent to the respective edges of blank ends 44*c*, 44*d*. Similarly, hem 52 is formed by folding a narrow portion of blank 44** entirely along edge 44*a* and securing hem 52 to blank 44 as by a line of stitching 50.

Ruffle 34 is similarly formed on upper edge 44*b* of blank 44 by folding edge 44*b* over on itself, preferably on the same side of 10*a* or 10*b* as hem 46 and 52, and attaching edge 44*b* along the base 38 of ruffle 34 by a line of stitching 40*b* substantially adjacent and parallel to inwardly turned edge 44*b*.

Although stitching is preferred, alternative means of maintaining hems 46, 52 and ruffle 34 in position could be utilized, such as gluing or attaching with sticky or iron-on fiber webbing seam tape, such as is known under the trade mark STITCH WITCHERY. For neatness, the extremes of edges 44*a*, 44*b*, 44*c* and 44*d* are tucked under and secured by lines of stitching 50, 40*a* and 48, respectively, in the conventional manner for forming hems.

Small straight cuts 52*a* are carefully made in hem 52, preferably parallel to edges 44*c*, 44*d* and substantially adjacent each opposing end thereof, for later insertion of cord 54.

A housing 42 for passage therethrough of arched-shaped frame piece 16 is formed by inserting a second line of stitching 40*b* parallel to line 40*a* and outward thereof, toward ruffle edge 36. Each line of stitching 40*a*, 40*b* is inserted substantially parallel to the entire length of edge 44*b* and penetrates through the multiple thickness of folded fabric body 44.

Cuts 42*a* are carefully made in housing 42 parallel to and substantially adjacent to hems 46 for insertion therethrough of frames piece 16 and 22, as described hereafter.

Once all hems, or housings 42, 46, 52, for encasing cord 54 and frame 14 are in place, and cuts 42*a*, 52*a* have been formed, frame 14 (which has been precut to a predetermined size, and fitted at each end 18, 24 with a sleeve 30) may be inserted into fabric construction 10 by threading curved rigid piece 16 into one of cuts 42*a* and through channel 42 along the entire length thereof. Each hem 46 is threaded over straight piece 22 such that hem 52 is loose at the lower edge 44*a* of fabric body 45. The presence of sleeves 30 over each rough edge 19, 25 (FIG. 2) protects fabric construction 12 from snagging during this process.

Cord 54 is then inserted into cut (or insertion site) 52*a* and threaded through the entire length of hem 52. Cord 54 is of substantially shorter length than hem 52, such that when cord ends 54*a* are subsequently threaded through holes 32, brought together and formed into knot 56 hem 52 is caused to be gathered over cord 54, in turn causing gathering of the attached fabric body 45. If desired, any excess length at cord ends 54*a* may be tightly wrapped around rod 22 at the center portion thereof prior to forming knot or bow 56.

After window treatment 10 is so constructed, an important step consists of closing or binding cuts 42*a*, 52*a* for a neat appearance and to prevent the fabric construction 12 from later slipping from its placement on the fully constructed frame 14. Such slippage is further deterred by the presence of the aforementioned sleeves 30.

To maintain rigidity of frame 16 one arm 28 of each elbow joint 26 is inserted snugly into corresponding ends 18, 24 of curved and straight (lower elongated) frame portions 16, 22, respectively, as previously described. Once frame 14 is secure, cord ends 54*a* are threaded, preferably upward, through holes 32 (previously described and shown in FIGS. 2 and 4) and brought together in a knot (or bow) 56.

Figures 9, 10, 11:
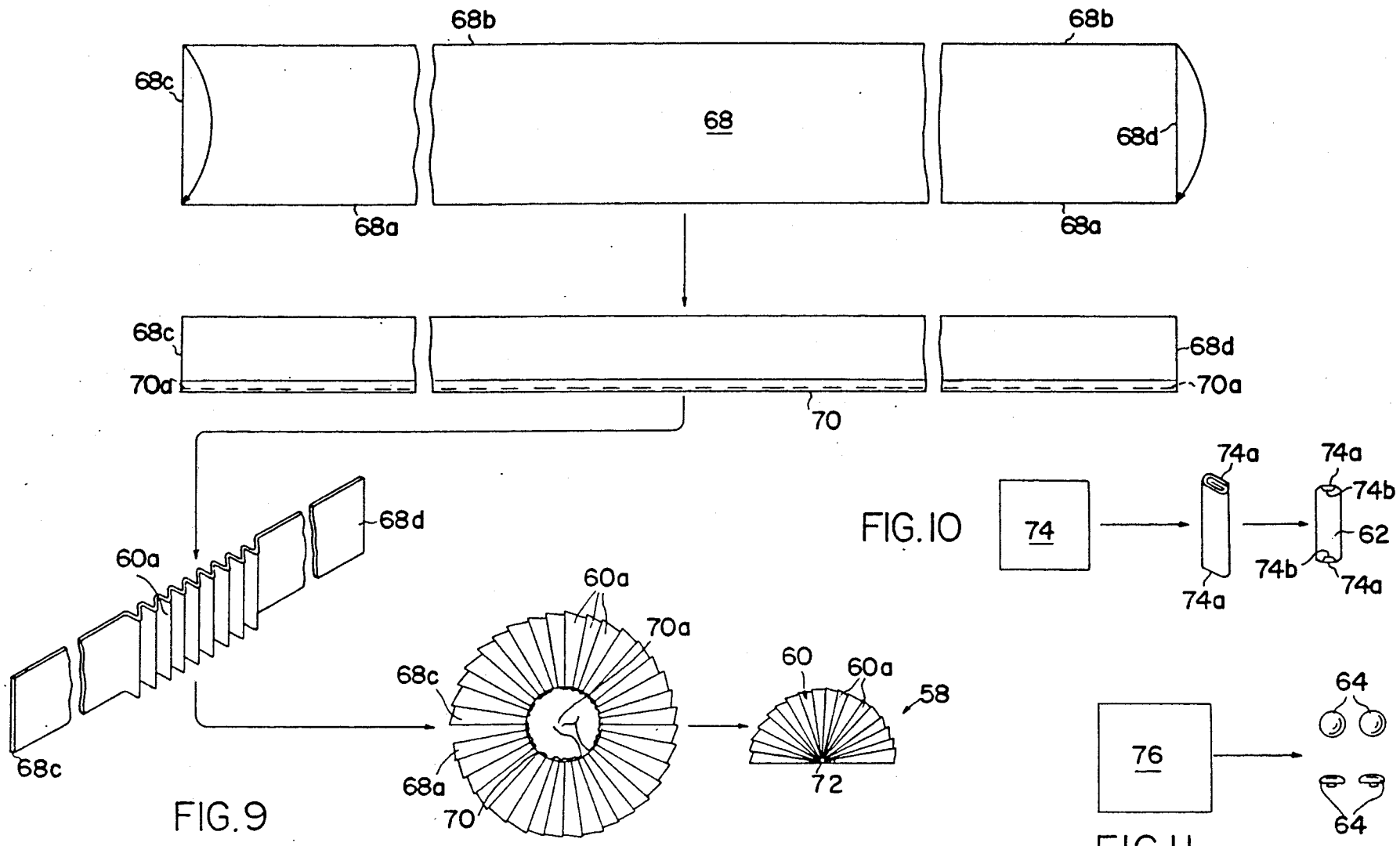
FIG. 9 is a plan view of the fabric of the decorative rosette of the window treatment of FIG. 1.
FIG. 10 is a plan view of the fabric of the tab of the window treatment of FIG. 1.
FIG. 11 is a plan view of fabric for covering the buttons of the window treatment of FIG. 1.

Rosette 58 is preferably formed by cutting a rectangular flexible material blank 68 of predetermined size and having parallel ends 68*c*, 68*d* perpendicular to parallel sides 68*a*, 68*b* (FIG. 9). Blank 68 is folded in half upon itself along a central longitudinal axis such that ends 68*c*, 68*d* are doubled and edges 68*a*, 68*b* overlay each other and are connected as by a line of stitching 70 inserted parallel to and substantially adjacent to overlapping edges 68*a*, 68*b*. Line of stitching 70 is formed loosely (commonly referred to as basting) and extends beyond ends 68*c*, 68*d* to terminate in free opposing thread ends 70*a*.

In the preferred manner, folds 60*a* are formed perpendicularly along the entire length of a longitudinal axis of previously folded blank 68 and preferably pressed so as to form sharp pleats, as illustrated in FIG. 9. Thread ends 70*a* are then carefully pulled so as to gather edges 68*a*, 68*b* therealong, while ends 68*c*, 68*d* are simultaneously turned toward each other until meeting and forming a substantially circular planar construction, for folding in half, upon itself, with the resultant semi-circular or 'sunburst' appearance of rosette 58.

Rosette 58 is preferably positioned with one of its two halves outward of and covering each side 10*a*, 10*b* of window treatment 10 at a lower central point thereon so as to hide from view lower elongated (straight) frame piece 22, knot 56 and hem 52. Pleated folds 60*a* are then attached to fabric body 45 as by small stitches, or "tacks" 66*a* (FIG. 5).

A tab 62 for covering central, gathered point 72 of rosette 58 is preferably formed (FIG. 10) by cutting a rectangular piece 74 of flexible material (for example, seven inches by six inches) and folding the same, into thirds or fourths in the same direction, and then folding ends 74*a* slightly inward toward each other and attaching, such as with stitches 74*b*, so as to provide a neat appearance.

Tab 62 is then folded outward of around central gathered point 72 of rosette 58 and secured thereto, such as by stitch 64*a* (FIG. 5). If desired, buttons 64 may be added next over tab 62 by means of an upholstery tack 64*b*, snaps or simultaneously via stitch 64*a*. Buttons 64 are each pre-covered by flexible material cut from blank 76 (FIG. 11). As an example, two such buttons 64, approximately one inch in diameter may be adequately covered from the fabric of a six inch by six inch square of fabric blank 76. Although optional, tab 62 and buttons 64 are preferred, to enhance the appearance of rosette 58 by hiding central gathered point 72 formed by pulling thread ends 70*a* and folding rosette 58 in half.

So constructed, with a neat appearance and preferably identical fabric on each side, window treatment 10 is thus fully reversible.

Window treatment 10 may be easily mounted on a wall W by first securing it thereto by any of a number of known curtain attachment devices, but preferably by using hardware such as clips 78 (FIG. 7), which each mount by insertion of a single screw or nail 80. Such mounting of a clip 78 causes opposing arms 82 thereof to pull toward each other in a spring-like manner such that fabric covered, arched, semi-rigid portion 16 of frame 14 may be forced between arms 82 and held tightly therein. It is preferred that three clips 78 be preplaced for mounting each window treatment 10, one near each end of semi-rigid arched portion 16 and one at the approximate center thereof (FIG. 1). However, more or fewer clips 78 might successfully be employed for this purpose. So mounted, fabric construction 12 hides clips 78 from view and yet may be very easily and simply removed from its position, reversed and remounted (without necessitating the use of any tools) when the first exposed side becomes soiled with dust, etc.

Accordingly, window treatment 10 may easily be used for twice as long as conventional arch-shaped, window treatments.

As is readily seen, window treatment 10 may be produced in any number of sizes and a variety of arched shapes, ranging from a true semi-circle to one half of any elliptical shape, either in a cross-wise or length-wise direction. For example, window treatment 10 may easily be constructed in sizes such as 53 inches wide by 29 inches high at the center, 38 inches wide by 22 inches high at the center, 34 inches wide by 12 inches high at the center, or 22 inches wide by 14 inches high at the center.

Any number of other sizes may also be provided simply by cutting the original blanks (as with conventional paper patterns) to form such pre-selected sizes. More specifically, an arched or sunburst shaped window treatment 10 having a dimensions of 22 inches wide by 14 inches high (at the center) would be formed from a blank 44 of dimensions 16 inches at side edges 44*c*, 44*d* and having a center distance from 44*a* to 44*b* of 19 inches, the entire blank 44 being 106 inches in length, from side 44*c* to side 44*d* along a longitudinal axis of blank 44.

Cutting the fabric for a window treatment 10 from pattern blanks of predetermined sizes and constructing the same as described above permits efficient use of time and materials. Formerly, the fabric construction in the area beneath a central decorative portion would merely be bunched together by hand from an excess allowed, tied together with a string in a wad, and excessive fabric just chopped off. Thus, a certain amount of material waste was necessitated by the ragged edges of the fabric being left after the gathering the of fabric body. Also, pre-cutting and stocking portions 16,22 of frame 14 in selected lengths permits faster construction of window treatment 10 when an order is received. Thus it may be seen that the new process for manufacturing window treatment 10 is more efficient and economical. In addition to being easily mounted and removed, the resultant product, being reversible and of high quality construction, is more durable than known window treatments.

In view of the foregoing, it will be seen that the several objects of the invention are achieved and other advantages are attained.

Although the forgoing includes a description of the best mode contemplated for carrying out the invention, various modifications are contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

What is claimed is:

1. A method for producing an arch-shaped window treatment, said method comprising:

cutting a one-piece longitudinal blank of flexible material to a predetermined size such that said blank has front and back sides and is provided with a curved, upper longitudinal edge and a lower longitudinal edge and two opposing end edges of equal length formed perpendicular to said lower longitudinal edge at opposing ends thereof and extending to opposing ends of the curved upper edge;

forming a hem in the lower longitudinal edge of the blank, the hem being of such width as to permit passage therethrough of a cord;

forming a hem in the curved, upper longitudinal edge of the flexible material blank; the curved, upper longitudinal edge hem being of such width as to accommodate passage there through of a frame curved portion; forming a hem at each end edge of the blank of such width as to accommodate the passage therethrough of a frame elongated portion;

forming entrance sites in the upper longitudinal edge hem and the lower longitudinal hem, for passage therethrough of window treatment frame pieces and a gathering cord, respectively;

mounting the flexible material blank upon a window treatment frame having a curved, semi-rigid upper, portion and a lower elongated piece;

connecting the respective first and second ends of the curved frame portion and the elongated frame piece;

closing the entrance sites;

gathering excess flexible material substantially centrally along the straight frame elongated portion by inserting a cord shorter than the length of the hem formed in the lower longitudinal edge of the blank into the entrance site therein and thorough the hem and pulling on opposing ends of the cord;

tying the cord so as to maintain the gathered portion of the flexible material substantially at the center of the lower elongated frame piece;

applying a decorative piece so as to shield from view the elongated frame piece, the tied cord and the lower hem gathered thereon;

mounting the window treatment on a wall in such manner that it is easily removed.

2. The method of claim 1, wherein the entrance sites in the upper longitudinal hem and the lower elongated hem are formed substantially adjacent to opposing ends thereof and the step of mounting the flexible material blank upon a window treatment frame having an upper curved portion and a lower elongated portion comprises consecutively inserting through the entrance sites in the upper longitudinal edge hem the upper curved portion of the frame, the lower elongated piece of the frame, and thereafter connecting opposing ends of the frame curved portion to corresponding opposing ends of the lower elongated piece, such that each straight end edge of the blank is mounted on the lower elongated piece and the curved frame portion is retained in the hem formed in the curved upper longitudinal edge of the window treatment blank.

3. The method of claim 1, and further comprising forming the window treatment frame pieces by cutting such pieces to predetermined sizes from commercially available lengths of curtain rod; forming an arch in one such precut length to create the upper curved semi-rigid portion of the frame; and mounting on opposing ends of each frame piece plastic sleeves to protect the fabric material construction from snagging on the frame piece ends;

further folding the folded, turned decorative piece blank to form two substantially semi-circular shaped halves;

finishing said window treatment by placing the folded, turned and further folded decorative piece outward of the lower elongated frame piece at a central location thereon, such that the lower frame elongated piece, the tied cord, and the lower hem gathered thereon are hidden from view;

attaching each of the folds of the decorative piece to the window treatment fabric body; and covering from view a lower central point formed on the decorative piece by the folding, turning and further folding thereof.

4. The method of claim 1, wherein the curved frame portion and the elongated piece are connected so as to be detachable at the respective ends thereof by inserting into corresponding ends, arms of elbow joints.

5. The method of claim 1, wherein the entrance sites are closed by inserting closely defined stitches into the fabric material construction so that the finished window treatment has a neat appearance.

6. The method of claim 1, and forming a ruffle along the length of upper longitudinal edge hem subsequent to forming such hem.

7. The method of claim 1, and maintaining the gathered excess flexible material in a focus by passing opposing ends of the cord through holes defined in the straight elongated piece.

8. The method of claim 1, and applying the decorative piece by stitching it to the body of the flexible material construction.

9. The method of claim 1, and forming the decorative piece from flexible material by performing the following steps:

cutting a rectangular decorative piece blank of a predetermined size from flexible material;

folding the decorative piece blank in half along a central lengthwise axis thereof, such that the first and second longitudinal edges meet at corresponding points along the respective lengths thereof;

connecting the first and second longitudinal edges along the lengths thereof;

forming folds perpendicular to the longitudinal axis of the folded decorative piece blank along the entire length thereof;

turning the folded decorative piece blank so that the first end meets the second end and a substantially circular planar shape is formed by the blank;

forming a hem in the lower longitudinal edge of the blank, the hem being of such width as to permit passage therethrough of a cord;

forming a hem in the curved, upper longitudinal edge of the flexible material blank; the curved, upper longitudinal edge hem being of such width as to accommodate passage therethrough of a frame curved portion; forming a hem at each end edge of the blank of such width as to accommodate the passage therethrough of a frame straight elongated portion;

forming entrance sites in the upper longitudinal edge hem and the lower elongated hem, for passage therethrough of window treatment frame pieces and a gathering cord, respectively;

mounting the flexible material blank upon a window treatment frame having an upper curved portion and a lower elongated portion;

detachably connecting the respective first and second ends of the upper curved frame portion and the lower elongated frame piece;

closing the entrance sites;

gathering excess flexible material substantially centrally along the elongated frame piece by inserting a cord shorter than the length of the hem formed in the lower longitudinal edge of the blank and pulling on opposing ends of the cord;

tying the cord so as to maintain the gathered portion of the flexible material substantially at the center of the elongated frame piece;

applying a decorative piece so as to shield from view the elongated frame piece, the tied cord and the lower hem gathered thereon;

mounting the window treatment on a wall in such manner that it is easily removed.

10. The method of claim 9, wherein the window treatment is formed so as to have a substantially identical front side and back side so as to be reversible, by cutting the one-piece longitudinal blank from flexible material which has front and back sides which are substantially identical; placing the folded decorative piece outward of and around the lower elongated frame piece such that the tied cord and lower hem gathered thereon are hidden from view from either side of the window treatment by one of the decorative piece halves, outward of each front and back side of the window treatment; and mounting the window treatment on a wall so that it is easily removed and reversed.

11. The window treatment of claim 9, wherein the folds of the decorative piece are attached to the window treatment by stitching each fold to the flexible material body.

12. The method of claim 9, wherein a gathered point formed on the decorative piece by the folding, turning and further folding thereof is covered from view by attaching thereover a tab of flexible material.

13. The method of claim 12, and attaching at least one button to the tab.

14. The method of claim 10, wherein the gathered point formed on the decorative piece by the folding, turning and further folding thereof is covered by applying a tab outward of and around the decorative piece and attaching a button to each end thereof such that the window treatment appears to be substantially identical from both front and back sides thereof and thus is reversible.

15. The method of claim 9, and pressing the folds formed perpendicular to the longitudinal axis of the folded decorative piece blank so as to form sharp pleats, the circular planar shape turned providing a rosette appearance; and the further folding thereof into a semicircle so as to cause the decorative piece to acquire a sunburst appearance with the pleats radiating outward from the gathered point.

16. The method of claim 1, wherein the window treatment is mounted upon a wall by preplacement of clips thereon such that the window treatment may be simply slipped between arms of the clips and easily removed therefrom without the use of tools.

* * * * *